US010570553B2

(12) United States Patent
Leibman et al.

(10) Patent No.: US 10,570,553 B2
(45) Date of Patent: Feb. 25, 2020

(54) WASHING MACHINE APPLIANCE WITH ARTICULATED FILL NOZZLE

(71) Applicant: Haier US Appliance Solutions, Inc., Wilmington, DE (US)

(72) Inventors: Alexander B. Leibman, Prospect, KY (US); Adam Raymond Mora, LaGrange, KY (US); Zackary Filbert, Louisville, KY (US); Todd Boutiette, Fisherville, KY (US); Manidhar V V S Yandamuri, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 139 days.

(21) Appl. No.: 15/915,124

(22) Filed: Mar. 8, 2018

(65) Prior Publication Data

US 2019/0276976 A1 Sep. 12, 2019

(51) Int. Cl.
*D06F 39/08* (2006.01)

(52) U.S. Cl.
CPC ..... *D06F 39/088* (2013.01)

(58) Field of Classification Search
CPC ..... D06F 39/088
See application file for complete search history.

(56) References Cited

FOREIGN PATENT DOCUMENTS

| | | |
|---|---|---|
| JP | 3906721 B2 | 4/2007 |
| JP | 2016049156 A | 4/2016 |
| KR | 20120044571 A | 5/2012 |

*Primary Examiner* — Spencer E Bell
(74) *Attorney, Agent, or Firm* — Dority & Manning, P.A.

(57) ABSTRACT

A washing machine appliance includes a cabinet having a top panel, a wash tub mounted within the cabinet below the top panel, and a door mounted to the cabinet at the top panel. The door is adjustable between an open position and a closed position. The door is positioned over the wash tub in the closed position. The washing machine appliance also includes a spray head mounted to the door with an articulated joint. The spray head is fluidly connected to a wash fluid source and is configured for selectively providing a flow of wash fluid in a desired direction and location within the wash tub when the door is in the open position.

18 Claims, 7 Drawing Sheets

WASHING MACHINE APPLIANCE WITH ARTICULATED FILL NOZZLE

FIELD OF THE INVENTION

The present subject matter relates generally to washing machine appliances and in particular to features providing a flow of wash fluid in washing machine appliances.

BACKGROUND OF THE INVENTION

Washing machine appliances generally include a tub for containing water or wash liquid, e.g., water and detergent, bleach, and/or other wash additives. A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

The volume of water or wash liquid needed may vary depending upon a variety of factors. For example, large loads can require a large volume of water relative to small loads that can require a small volume of water. A user may wish to have additional wash liquid dispensed in order to perform a specific task, e.g., prewash an article of clothing or add additional liquid to accommodate an extra-large load. However, conventional washing machine appliances typically do not have water-on-demand features, and those that do require additional valves, hoses, clamps, and other hardware to perform such a function. A user may wish to direct the flow of wash fluid onto a particular garment or within a specific region of the wash tub, e.g., to perform a pretreating operation, to saturate a particular article of clothing, or to accommodate an extra-large load. The ability to adjust the amount of wash fluid and its dispensing location is a commercially desirable feature and increases the user's positive perception of the wash process generally.

Accordingly, a washing machine appliance that provides a user with more control over the water or wash liquid fill amount is desirable. In particular, a washing machine appliance with features for controlling and directing the wash fluid fill would be particularly beneficial.

BRIEF DESCRIPTION OF THE INVENTION

The present subject matter provides a washing machine appliance with a cabinet, a wash tub within the cabinet, a door mounted to the cabinet for selectively providing access to or enclosing the wash tub, and a spray head mounted to the door with an articulated joint. Additional aspects and advantages of the invention will be set forth in part in the following description, or may be apparent from the description, or may be learned through practice of the invention.

In one embodiment, a washing machine appliance defining a vertical direction, a lateral direction, and a transverse direction is provided. The vertical direction, the lateral direction and the transverse direction are mutually perpendicular. The washing machine appliance includes a cabinet extending between a top and a bottom along the vertical direction. The cabinet has a top panel positioned at the top of the cabinet. The washing machine appliance also includes a wash tub mounted within the cabinet below the top panel and configured for containing fluid during operation of the washing machine appliance. The washing machine appliance further includes a door mounted to the cabinet at the top panel such that the door is adjustable between an open position and a closed position where the door is positioned over the wash tub in the closed position. The washing machine appliance also includes a spray head mounted to the door with an articulated joint such that the spray head is rotatable relative to the door about at least one of the vertical direction, the lateral direction and the transverse direction. The spray head is fluidly connected to a wash fluid source and configured for selectively providing a flow of wash fluid in a desired direction and location within the wash tub when the door is in the open position.

In another embodiment, a washing machine appliance is provided. The washing machine appliance includes a cabinet having a top panel with a wash tub mounted within the cabinet below the top panel. The wash tub is configured for containing fluid during operation of the washing machine appliance. The washing machine appliance also includes a door mounted to the cabinet at the top panel such that the door is adjustable between an open position and a closed position. The door is positioned over the wash tub in the closed position. The washing machine appliance further includes a spray head mounted to the door with an articulated joint such that the spray head is movable relative to the door. The spray head is fluidly connected to a wash fluid source and configured for selectively providing a flow of wash fluid in a desired direction and location within the wash tub when the door is in the open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
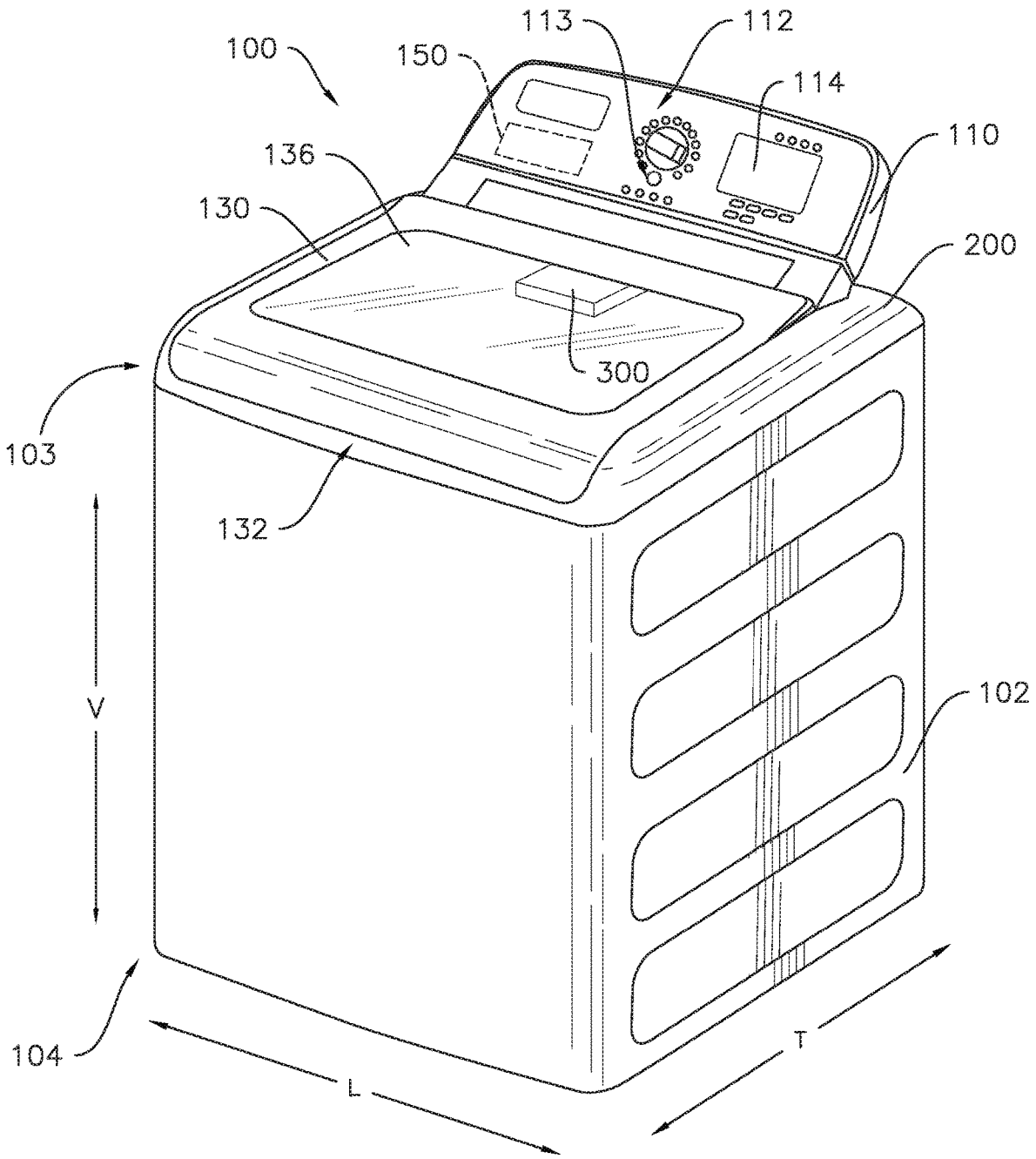
FIG. 1 provides a perspective view of an exemplary washing machine appliance that may incorporate various embodiments of the present subject matter with a door or lid of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
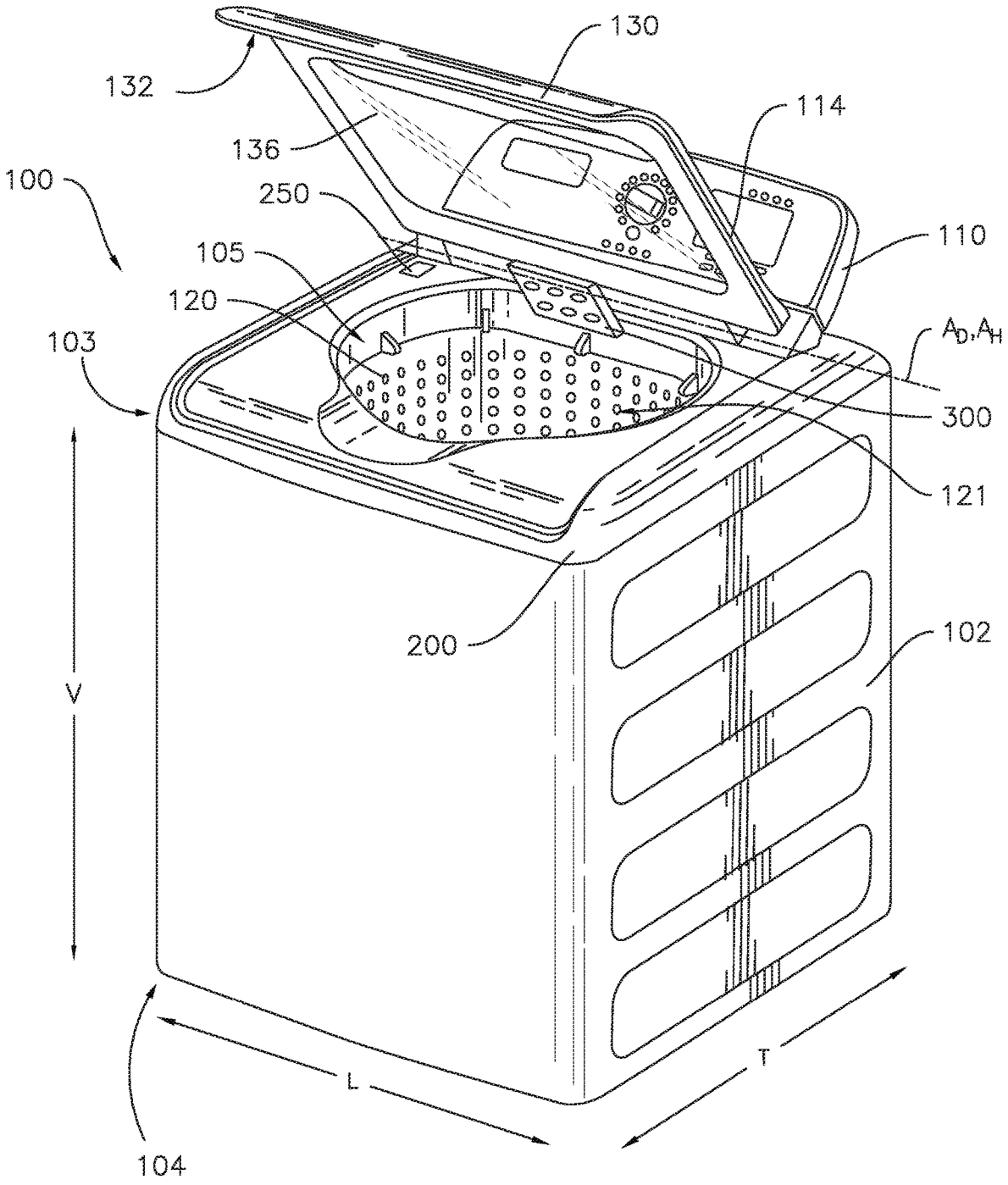
FIG. 2 provides a perspective view of the exemplary washing machine appliance of FIG. 1 with the door of the washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that defines a lateral direction L, a transverse direction T, and a vertical direction V. The lateral direction L, transverse direction T, and vertical direction V are mutually perpendicular and define an orthogonal coordinate system. As shown, cabinet 102 extends between a top 103 and a bottom 104 along the vertical direction V. A wash basket 120 (FIG. 2) is rotatably mounted within cabinet 102. For example, a wash tub 124 (FIG. 3) may mounted within the cabinet 102, as described in more detail below, and the wash basket 120 may be rotatably mounted within the wash tub 124. A motor (not shown) is in mechanical communication with wash basket 120 in order to selectively rotate wash basket 120 (e.g., during an agitation or a rinse cycle of washing machine appliance 100). Wash basket 120 defines a wash chamber 121 (FIG. 2) that is configured for receipt of articles for washing. An agitator or impeller extends from wash basket 120 into wash chamber 121 to assist agitation of articles disposed within wash chamber 121 during operation of washing machine appliance 100.

Cabinet 102 of washing machine appliance 100 has a top panel 200. Top panel 200 defines an aperture 105 (FIG. 2) that permits user access to wash chamber 121 of wash basket 120. Door 130 is rotatably mounted to top panel 200. However, alternatively, door 130 may be mounted to cabinet 102 or any outer suitable support. Door 130 selectively rotates between the closed position shown in FIG. 1 and the open position shown in FIG. 2. In the closed position, door 130 is positioned over the wash tub 124 such that the door 130 encloses the wash tub 124 and inhibits access to wash chamber 121 in the closed position. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130. As may be seen in FIG. 2, washing machine appliance 100 may include a spray head 300 mounted to the door 130. As described in more detail below, the spray head 300 may be mounted to the door with an articulated joint 302 (e.g., FIGS. 3 and 4) such that the spray head 300 can be pivoted and/or rotated to selectively provide a flow of wash fluid into the wash tub 124 in a desired direction and location. For example, in at least some embodiments, the spray head is rotatable relative to the door about at least one of the vertical direction, the lateral direction and the transverse direction. Also, the spray head 300 is visible when the door 130 is in the closed position, e.g., the spray head 300 may be seen through the window 136 when the door 130 is in the closed position.

Various valves may regulate the flow of fluid into and through washing machine appliance 100 from water sources 76 and 77, e.g., water source 76 may include one or more fluid lines, pipes, conduits, etc. which provide hot water to washing machine appliance 100, e.g., from a residential water heater (not shown) and water source 77 may include one or more fluid lines, pipes, conduits, etc. which provide cold water to washing machine appliance 100. For example, a hot water valve 78 and a cold water valve 80 may be positioned in such fluid lines to flow hot water and cold water, respectively, to washing machine appliance 100.

Figure 3:
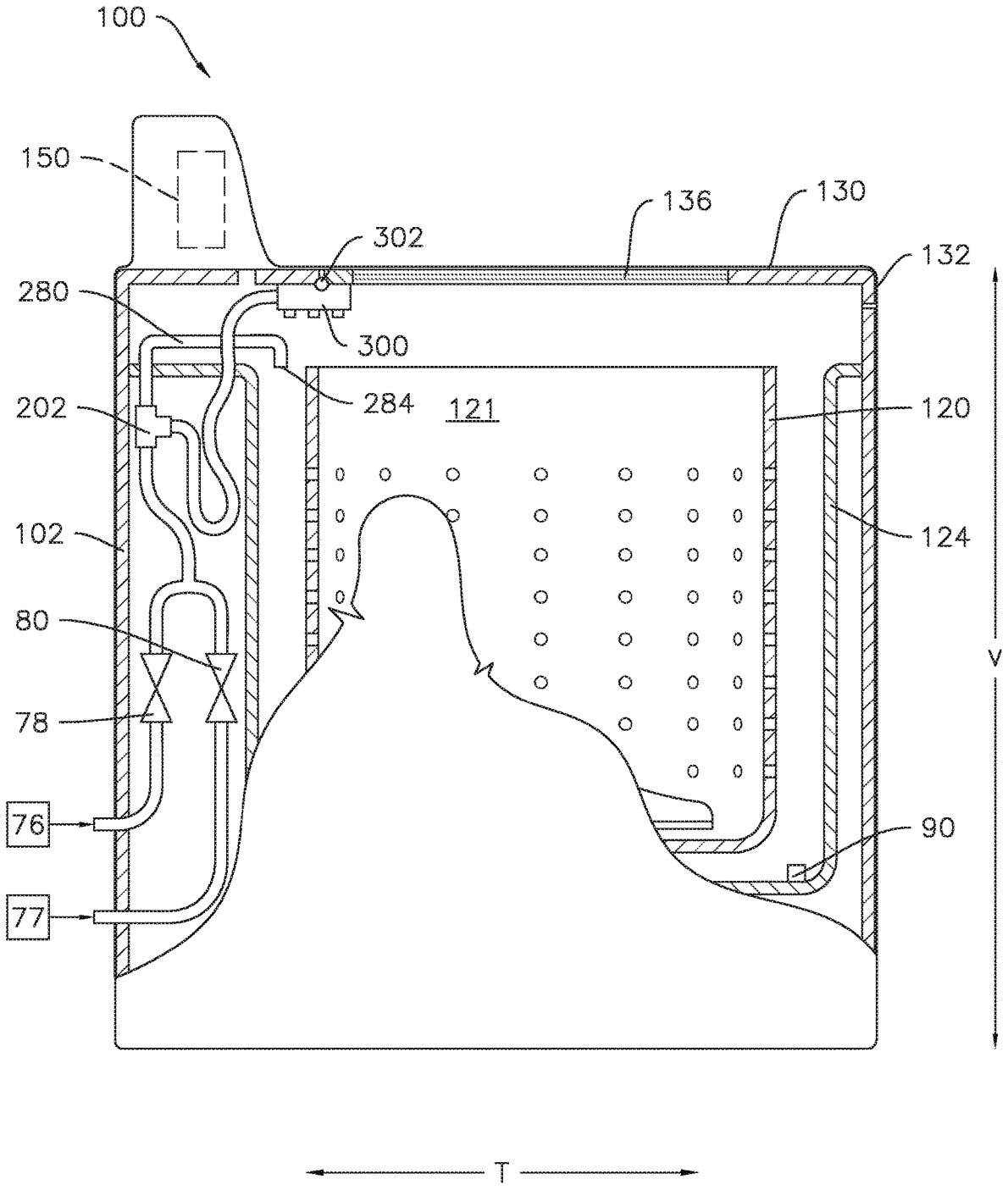
FIG. 3 provides a side cutaway view of the exemplary washing machine appliance of FIG. 1 including an articulated spray head fill nozzle according to one or more exemplary embodiments of the present subject matter.

As shown for example in FIG. 3, each valve 78, 80 may be selectively adjusted between an open position allowing a flow of fluid therethrough and a closed position terminating or obstructing the flow of fluid therethrough. Hot water valve 78 may be in fluid communication with hot water source 76, which may be external to the washing machine appliance 100. Similarly, cold water valve 80 may be in fluid communication with cold water source 77, which may also be external to the washing machine appliance 100. The cold water source 77 may, for example, be a commercial water supply, while the hot water source 76 may be, for example, a water heater appliance.

A control panel 110 with a plurality of input selectors 112 (FIG. 1) extends from top panel 200. Control panel 110 and input selectors 112 collectively form a user interface input for operator selection of machine cycles and features. A display 114 of control panel 110 indicates selected features, a countdown timer, and/or other items of interest to appliance users.

Figure 4:
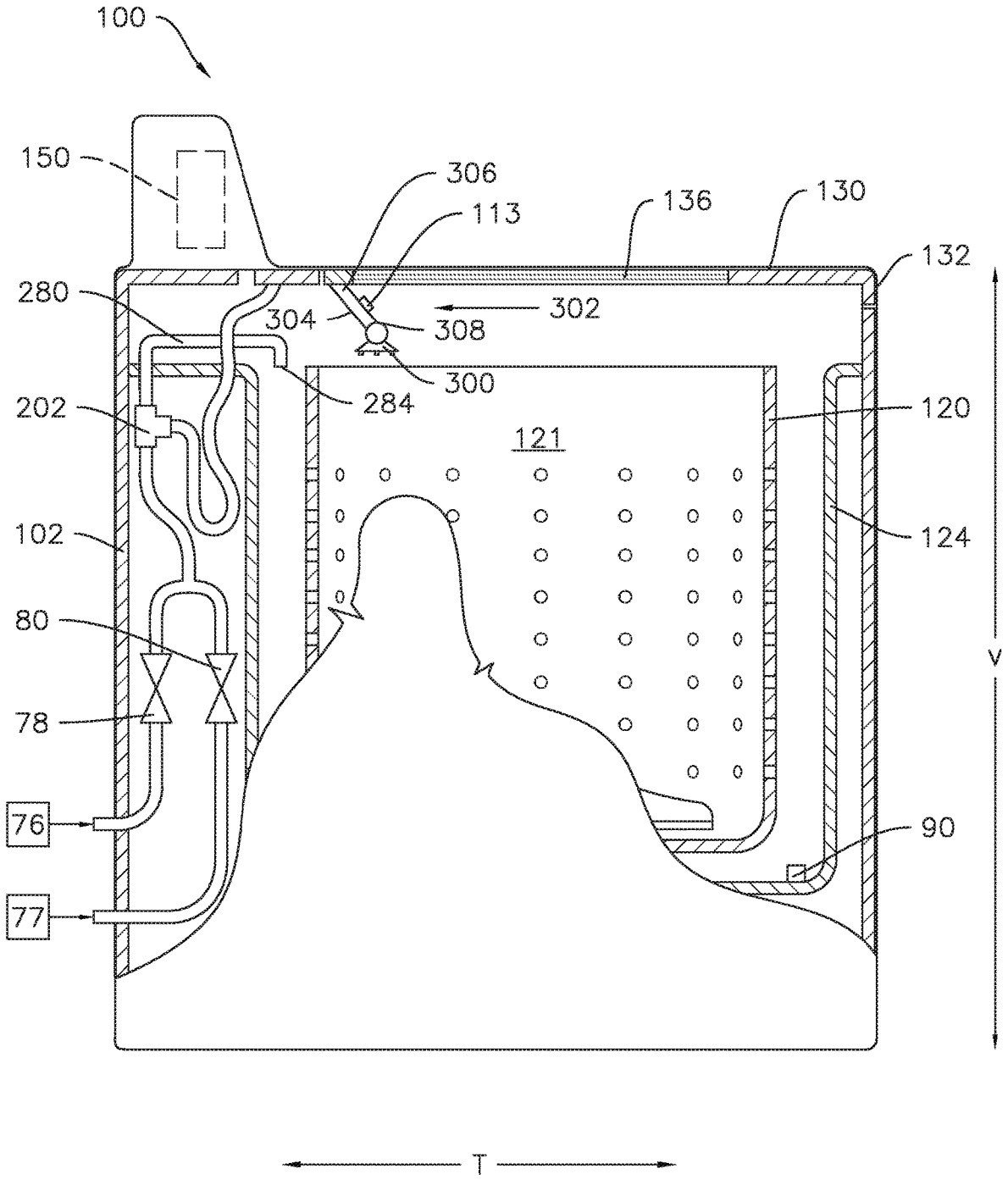
FIG. 4 provides a side cutaway view of the exemplary washing machine appliance of FIG. 1 including an articulated spray head fill nozzle according to one or more additional exemplary embodiments of the present subject matter.

Various sensors may additionally be included in the washing machine appliance 100. For example, a pressure sensor 90 may be positioned in the tub 124 as illustrated in FIGS. 3 and 4. Any suitable pressure sensor 90, such as an electronic sensor, a manometer, or another suitable gauge or sensor may be utilized. The pressure sensor 90 may generally measure the pressure of water in the tub 124. This pressure can then be utilized to estimate the height or level of water in the tub 124. Additionally, a suitable speed sensor (not shown) can be provided to measure rotational speed of basket 120. Other suitable sensors, such as temperature sensors, etc., may additionally be provided in the washing machine appliance 100.

Operation of washing machine appliance 100 is controlled by a controller or processing device 150 that is operatively coupled to control panel 110 for user manipulation to select washing machine cycles and features. In response to user manipulation of control panel 110 the controller 150 operates the various components of washing machine appliance 100 to execute selected machine cycles and features. For example, the controller 150 may be in communication with (e.g., electrically coupled to) the input selectors 112 for user manipulation to select washing machine cycles and features. As illustrated, the input selectors 112 may be knobs or dials. In various embodiments, the input selectors 112 may include one or more user input devices, such as switches, buttons, touchscreen interfaces, etc., as well as or instead of the illustrated example input selectors 112. Appliance controller 150 may further be in communication with (e.g., electrically coupled to) various other components of appliance 100, such as one or more valves, pressure sensor 90, one or more additional suitable sensors, etc.

Appliance controller 150 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, appliance controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100, such as the door 130, one or more valves, pressure sensor 90, and various other sensors, etc. may be in communication with appliance controller 150 via one or more signal lines or shared communication busses. It should be noted that controllers 150 as disclosed herein are capable of and may be operable to perform any methods and associated method steps as disclosed herein. For example, in some embodiments, methods disclosed herein may be embodied in programming instructions stored in the memory and executed by the controller 150.

In an illustrative embodiment, laundry items may be loaded into wash chamber 121 through aperture 105, and washing operation may be initiated through operator manipulation of input selectors 112. Wash basket 120 (and/or wash tub 124 shown in FIG. 3) may be filled with water and detergent to form a wash fluid. As used herein, "wash fluid" may refer to water, detergent, fabric softener, bleach, or any other suitable wash additive or combination thereof. One or more valves, e.g., valves 78 and 80, can be controlled by controller 150 to provide for filling wash basket 120 to the appropriate level for the amount of articles being washed. Once wash basket 120 is properly filled with fluid, the contents of wash chamber 121 are agitated for cleansing of laundry items in wash basket 120.

After the agitation phase of the wash cycle is completed, wash basket 120 may be drained. Laundry articles can then be rinsed by again adding fluid to wash basket 120, depending on the particulars of the cleaning cycle selected by a user, impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through aperture 105.

Wash tub 124 is configured for containing fluid, e.g., wash and rinse fluids, during operation of washing machine appliance 100 described above. Wash and rinse fluids disposed within wash tub 124 can be used to clean articles disposed in wash basket 120. Wash and rinse fluids can pass between wash basket 120 and wash tub 124 through a plurality of apertures defined by wash basket 120, e.g., during the wash and/or spin cycles described above.

As illustrated for example in FIG. 3, washing machine appliance 100 further includes a spray head 300 fluidly connected to one or more of the water sources 76, 77 and configured for selectively providing a flow of wash fluid, e.g., water and/or detergent, etc., in a desired direction and location. The spray head 300 may be configured to provide the flow of wash fluid when the door 130 is in the open position. For example, as described in more detail below, in some embodiments, the spray head 300 may provide the flow of wash fluid only when the door 130 is in the open position. In other embodiments, the spray head 300 may provide the flow of wash fluid when the door 130 is in the open position and/or when the door 130 is in the closed position, e.g., the spray head 300 may provide the flow of wash fluid independent of the position of the door 130. More particularly, for the embodiment depicted, spray head 300 is fluidly connected to a three-way valve 202. In the illustrated example, the valve 202 is positioned within cabinet 102, however, in various other embodiments, the valve 202 may also be positioned within or proximate to the control panel or external to the cabinet 102. The three-way valve 202 has two outlets, a first outlet provides a flow of wash fluid to the spray head 300 and a second outlet provides the flow of wash fluid to a supply conduit 280. Three-way valve 202 is depicted as a T-valve downstream of valves 78, 80. However, in other exemplary embodiments, any suitable three-way valve 202 may be utilized, and further, three-way valve 202 may be attached in any suitable location. For example, in other embodiments, three-way valve 202 may be a Y-valve, and/or may be upstream of valves 78, 80. In the latter embodiment, washing machine appliance 100 may further include two three-way valves, such that a first three-way valve is upstream of hot water valve 78, and a second three-way valve is upstream of cold water valve 80. By being positioned upstream of valves 78, 80, spray head 300 may provide a flow of water independently from a flow of water provided to other parts of the washing machine appliance 100 (i.e., independently of whether or not valves 78, 80 are open or closed). Alternatively, a single three-way valve may be provided upstream of either hot water valve 78 or cold water valve 80. Notably, in such an embodiment, a spray head 300 may only provide hot water or cold water, respectively.

Figure 5:
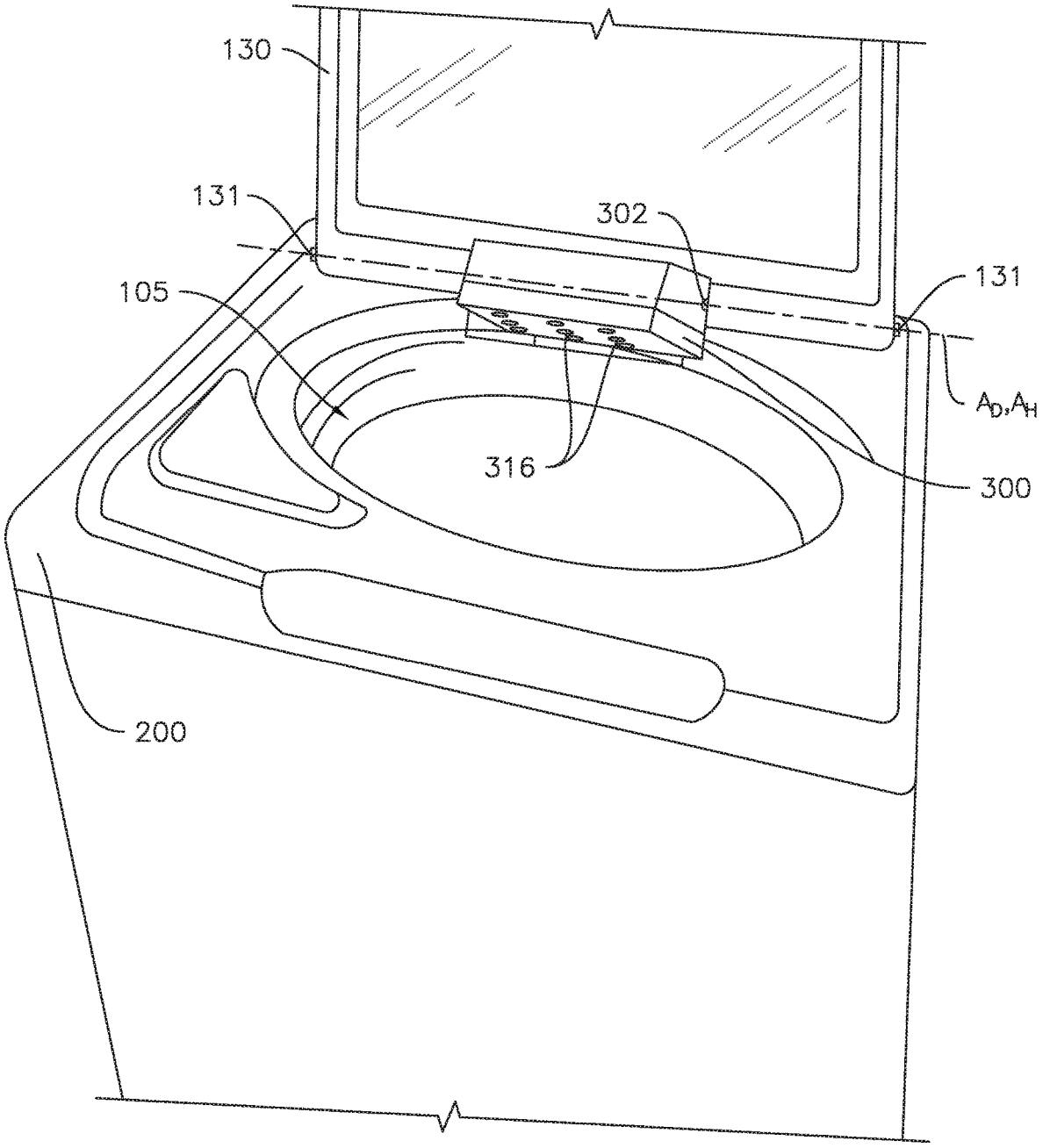
FIG. 5 provides an enlarged perspective view of a spray head fill nozzle according to one or more exemplary embodiments of the present subject matter.

As noted above, the spray head 300 may be mounted to the door 130 with an articulated joint 302. As used herein, the spray head 300 is "mounted to" the door 130 when the spray head 300 is connected to, e.g., directly connected to, the door 130 and supported by the door 130. The spray head 300 when mounted to the door 130 may be supported by the door 130 in that the door 130 provides structural support for the spray head 300, and/or forms an essential element of a connection between the spray head 300 and the remainder of the washing machine appliance 100, e.g., between the spray head 300 and the cabinet 102. Additionally, the door 130 may provide a frame of reference for locating the spray head 300 relative to the wash tub 124 when the spray head 300 is mounted to the door 130. In some embodiments, for example as illustrated in FIGS. 3 and 5, the articulated joint 302 may be a hinge joint. In such embodiments where the spray head 300 is mounted to the door 130 with a hinge joint 302, the spray head 300 is pivotable relative to the door 130 about a single pivot axis $A_H$ defined by the hinge joint 302. For example, the single pivot axis $A_H$ may be oriented generally along the lateral direction L such that the spray head 300 is rotatable relative to the door 130 about the lateral direction L. The door 130 may be mounted to the top panel 200 of the cabinet 102 by a hinge 131, as shown, e.g., in FIG. 5. The hinge 131 may define a hinge axis $A_D$ of the door 130 whereby the door 130 is pivotable about the hinge axis $A_D$ between the open position and the closed position. In various embodiments, the single pivot axis of the spray head 300 may be generally parallel to the hinge axis $A_D$ of the door 130. For example, the single pivot axis $A_H$ of the spray head 300 may be parallel to and offset from the hinge axis $A_D$ of the door 130, or the single pivot axis $A_H$ of the spray head 300 may be collinear with the hinge axis $A_D$ of the door 130, as illustrated in FIGS. 2 and 5. As used herein, terms of approximation, such as "generally," or "about" include values within ten percent greater or less than the stated value. When used in the context of an angle or direction, such terms include within ten degrees greater or less than the stated angle or direction. For example, the single pivot axis $A_H$ of the spray head 300 may be generally parallel to the hinge axis $A_D$ of the door 130 when the single pivot axis $A_H$ of the spray head 300 forms an angle of up to 10° in any direction with the hinge axis $A_D$ of the door 130.

Figure 6:
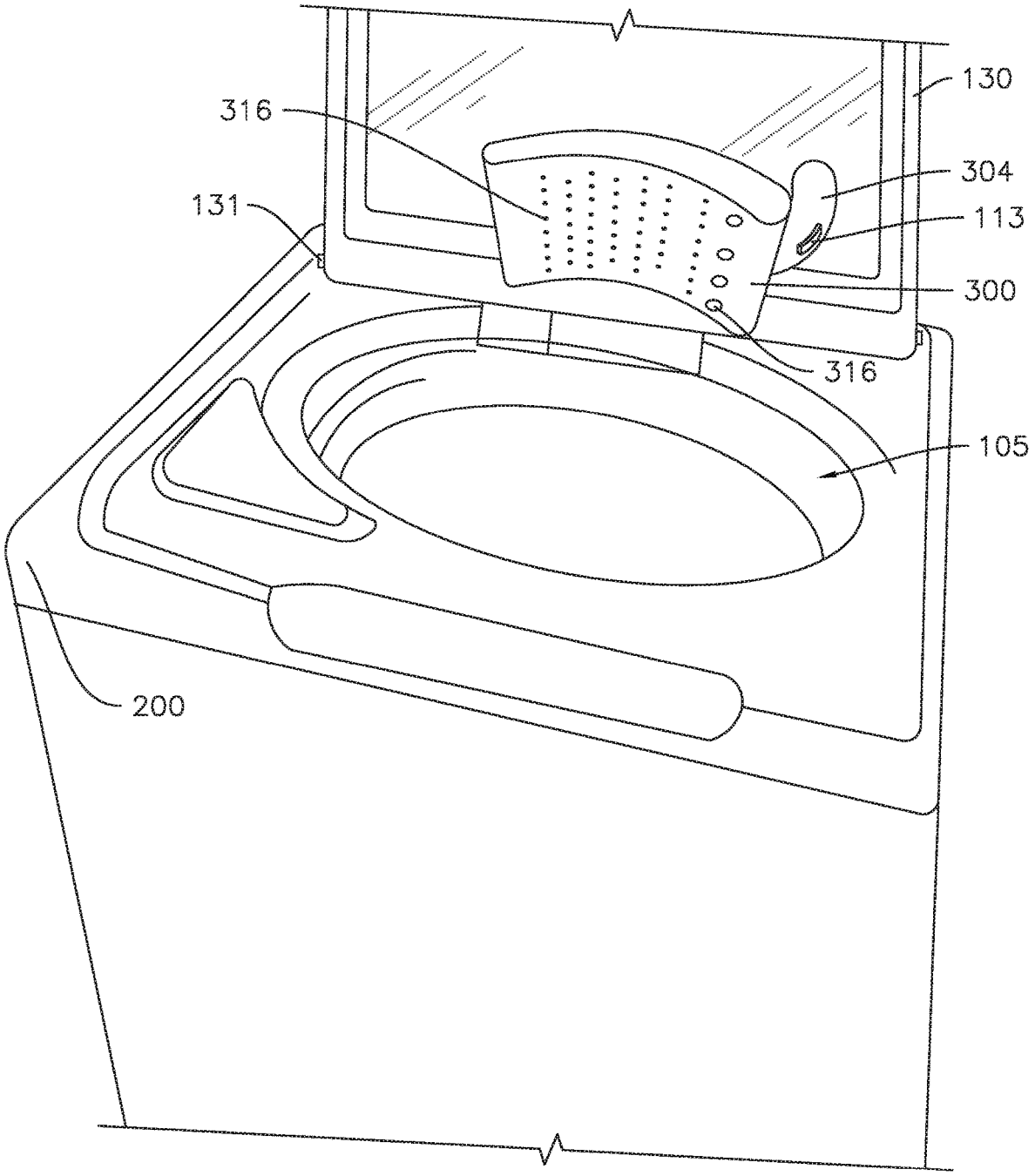
FIG. 6 provides an enlarged perspective view of a spray head fill nozzle according to one or more additional exemplary embodiments of the present subject matter.

In some embodiments, for example as illustrated in FIGS. 4 and 6, the articulated joint 302 may be a ball joint, such that the spray head is rotatable relative to the door with at least three degrees of freedom. In embodiments wherein the articulated joint 302 comprises a ball joint, the spray head 300 may be rotatable relative to the door 130 about the lateral direction L and at least one of the vertical direction V and the transverse direction T. In at least some embodiments wherein the articulated joint 302 comprises a ball joint, the spray head 300 may be rotatable relative to the door 130 about all three of the lateral direction L, the vertical direction V, and the transverse direction T.

In some embodiments, the articulated joint 302 may include an arm 304 connected to the door 130 at a first end 306 and connected to the spray head 300 at a second end 308. The first end 306 of the arm 304 may be connected to the door 130 by a rotatable or pivotable joint, e.g., a hinge joint or a ball joint, such that the arm 304 is pivotable relative to the door 130 about one or more of the lateral direction L, the vertical direction V, and the transverse direction T via the pivotable joint. The spray head 300 may be connected to the second end 308 of the arm 304, and thus to the door 130 via the arm 304, by a ball joint. In such embodiments, the arm 304 may be considered part of the articulated joint 302, such that the spray head 300 may be considered directly connected to the door 130 by the articulated joint 302 when the spray head 300 is directly connected to the second end 308 of the arm 304 and the first end 306 of the arm 304 is directly connected to the door 130. In other embodiments, the spray head 300 may be directly connected to the door 130 by a ball joint, without the intervening arm 304.

As mentioned above, the washing machine appliance 100 may be configured to selectively provide a flow of wash fluid to one of the spray head 300 or supply conduit 280, for example, via three-way valve 202. The supply conduit 280 may include an exit 284 positioned for directing wash fluid from a wash fluid source, e.g., one or both of water sources 76 and 77, into the tub 124. The wash fluid source may also include an additive source, such as a reservoir containing detergent, pretreatment solution, or other cleaning agents or additives. The three-way valve 202 may be in operative communication with the controller 150 such that the controller 150 may actuate the valve 202 to provide wash fluid to a selected one of the spray head 300 and the supply conduit 280. For example, the controller 150 may actuate the valve 202 in response to a signal from a door sensor 250 and/or from a water supply input 113 (FIGS. 1 and 4). In some embodiments, the controller 150 may actuate the valve 202 to supply wash fluid to the supply conduit 280 in response to a signal from the sensor 250 that the door 130 is in the closed position and may actuate the valve 202 to supply wash fluid to the spray head 300 in response to a signal from the sensor 250 that the door 130 is in the open position. In additional embodiments, the controller 150 may also or instead be configured to actuate the valve 202 in response to a signal from the water supply input 113, e.g., a user input may be provided to select one of the spray head 300 or the supply conduit 280 as the source of wash fluid to fill the tub 124 independent of the position of the door 130. In the illustrated example embodiments of FIGS. 1 and 4, the water supply input may be a button which toggles the supply of water from water sources 76 and/or 77 between the supply conduit 280 and the spray head 300. For example, as illustrated in FIG. 1, the water supply button 113 may be positioned on the control panel 110, e.g., proximate to or among the user input selectors 112. As another example, the water supply button 113 may be positioned on or close to the spray head 300, such as on the arm 304 as illustrated in FIG. 4. In other embodiments, the water supply input 113 may be provided in any suitable form, such as but not limited to a toggle switch, a smart key, a knob or dial, etc.

As best seen in FIGS. 5 and 6, spray head 300 includes a plurality of outlets 316 through which a wash fluid, e.g., water, may be sprayed for directing the flow of wash fluid to desired locations, e.g., in the tub 124. In various embodiments, outlets 316 may, for example, be tubes extending from the spray head 300, or alternatively may simply be holes or apertures defined in the spray head 300. However, in other embodiments, outlets 316 may be nozzles or any other suitable openings through which wash fluid may be sprayed. Further, spray head 300 may additionally include other openings, holes, etc. (not shown) through which water may be flowed, i.e., sprayed or poured, into the tub 124 and/or basket 120.

Figure 7:
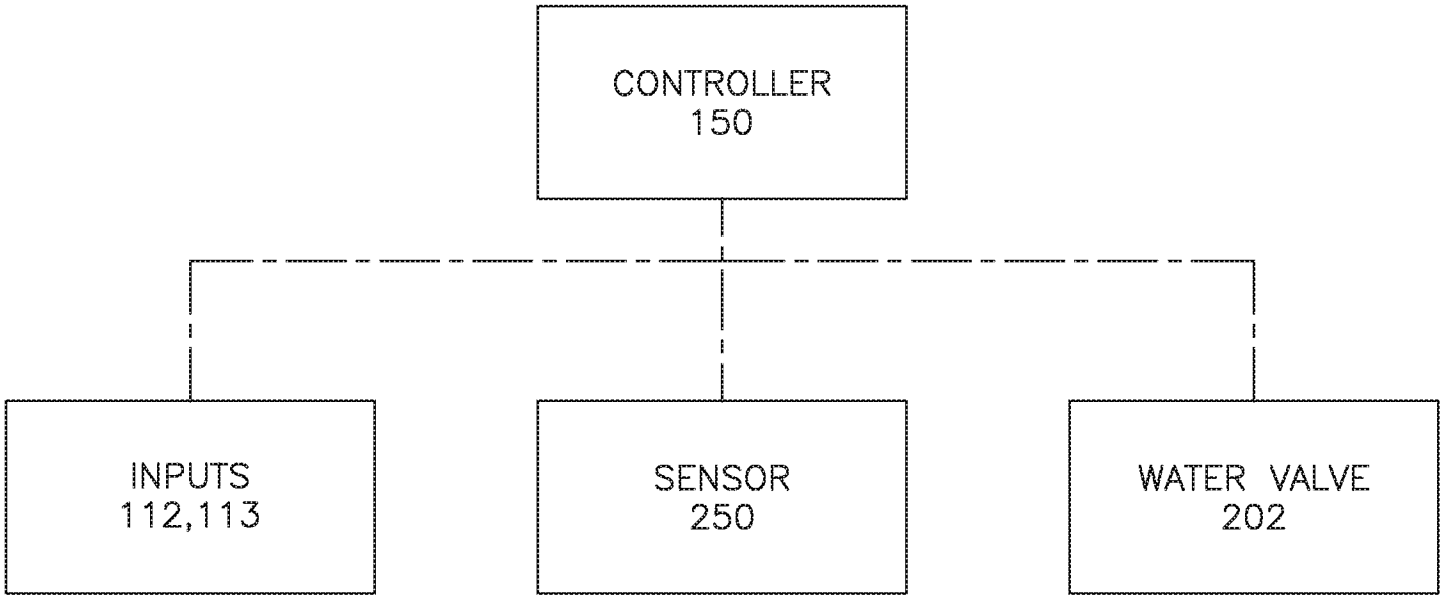
FIG. 7 provides a schematic view of certain components of the exemplary washing machine appliance of FIG. 1.

FIG. 7 provides a schematic view of certain components of washing machine appliance 100. As may be seen in FIGS. 2 and 7, washing machine appliance 100 includes door position sensor 250 that is positioned proximate door 130. Position sensor 250 is configured for detecting when door 130 is in the open position and is in communication with controller 108. Thus, position sensor 250 may signal controller 108 when door 130 is in the open position. Position sensor 250 may be any suitable type of sensor for detecting when door 130 is in the open position. As an example, position sensor 250 may be a plunger switch that is actuated when door 130 shifts from the closed position to the open position. As another example, position sensor 250 may be a reed switch or Hall Effect sensor that is actuated, e.g., by a magnet on door 130, when door 130 shifts from the closed position to the open position. As an additional example, position sensor 250 may be a pressure sensor or an optical sensor that is actuated when door 130 shifts from the closed position to the open position. One of ordinary skill in the art will recognize that other types of sensors may be used as position sensor 250 to detect when door 130 is in the open position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, a lateral direction, and a transverse direction, the vertical direction, the lateral direction and the transverse direction are mutually perpendicular, the washing machine appliance comprising:

a cabinet extending between a top and a bottom along the vertical direction, the cabinet having a top panel positioned at the top of the cabinet;

a wash tub mounted within the cabinet below the top panel and configured for containing fluid during operation of the washing machine appliance;

a door mounted to the cabinet at the top panel, the door adjustable between an open position and a closed position, the door positioned over the wash tub in the closed position; and a spray head mounted to the door with an articulated joint such that the spray head is rotatable relative to the door about at least one of the vertical direction, the lateral direction and the transverse direction, the spray head fluidly connected to a wash fluid source and configured for selectively providing a flow of wash fluid in a desired direction and location within the wash tub when the door is in the open position.

2. The washing machine appliance of claim 1, wherein the articulated joint is a hinge joint, whereby the spray head is pivotable relative to the door about a single pivot axis defined by the hinge joint, the single pivot axis oriented generally along the lateral direction such that the spray head is rotatable relative to the door about the lateral direction.

3. The washing machine appliance of claim 2, wherein the door is mounted to the top panel of the cabinet by a hinge, the hinge defining a hinge axis of the door whereby the door is pivotable about the hinge axis between the open position and the closed position, and wherein the single pivot axis of the spray head is generally parallel to the hinge axis of the door.

4. The washing machine appliance of claim 1, wherein the articulated joint is a ball joint, whereby the spray head is rotatable relative to the door about the lateral direction and at least one of the vertical direction and the transverse direction.

5. The washing machine appliance of claim 1, wherein the articulated joint comprises an arm between the door and the spray head, the spray head connected to the pivot arm by a ball joint, the spray head rotatable relative to the door about the lateral direction and at least one of the vertical direction and the transverse direction via the ball joint.

6. The washing machine appliance of claim 5, wherein the arm is connected to the door by a pivotable joint, the arm pivotable relative to the door about the lateral direction via the pivotable joint.

7. The washing machine appliance of claim 1, further comprising a supply conduit having an exit positioned for directing wash fluid from the wash fluid source into the tub and a valve connected to the wash fluid source, the valve configured for selectively providing wash fluid from the wash fluid source to one of the supply conduit and the spray head.

8. The washing machine appliance of claim 7, further comprising a position sensor operable to sense a position of the door, and a controller in operative communication with the sensor and the valve, the controller operable to actuate the valve to supply wash fluid to the supply conduit in response to a signal from the sensor that the door is in the closed position and operable to actuate the valve to supply wash fluid to the spray head in response to a signal from the sensor that the door is in the open position.

9. The washing machine appliance of claim 7, further comprising a control panel positioned on the cabinet, the control panel comprising a plurality of user inputs including a water supply input, and a controller in operative communication with the water supply input and the valve, the controller operable to actuate the valve in response to a signal from the water supply input.

10. A washing machine appliance comprising:

a cabinet having a top panel;

a wash tub mounted within the cabinet below the top panel and configured for containing fluid during operation of the washing machine appliance;

a door mounted to the cabinet at the top panel, the door adjustable between an open position and a closed position, the door positioned over the wash tub in the closed position; and a spray head mounted to the door with an articulated joint whereby the spray head is movable relative to the door, the spray head fluidly connected to a wash fluid source and configured for selectively providing a flow of wash fluid in a desired direction and location within the wash tub when the door is in the open position.

11. The washing machine appliance of claim 10, wherein the articulated joint is a hinge joint, whereby the spray head is pivotable relative to the door about a single pivot axis defined by the hinge joint.

12. The washing machine appliance of claim 11, wherein the door is mounted to the top panel of the cabinet by a hinge, the hinge defining a hinge axis of the door whereby the door is pivotable about the hinge axis between the open position and the closed position, and wherein the single pivot axis of the spray head is generally parallel to the hinge axis of the door.

13. The washing machine appliance of claim 10, wherein the articulated joint is a ball joint, whereby the spray head is rotatable relative to the door with at least three degrees of freedom.

14. The washing machine appliance of claim 10, wherein the articulated joint comprises an arm between the door and the spray head, the spray head connected to the arm by a ball joint.

15. The washing machine appliance of claim 14, wherein the arm is connected to the door by a rotatable joint.

16. The washing machine appliance of claim 10, further comprising a supply conduit having an exit positioned for directing wash fluid from the wash fluid source into the tub and a valve connected to the wash fluid source, the valve configured for selectively providing wash fluid from the wash fluid source to one of the supply conduit and the spray head.

17. The washing machine appliance of claim 16, further comprising a position sensor operable to sense a position of the door, and a controller in operative communication with the sensor and the valve, the controller operable to actuate the valve to supply wash fluid to the supply conduit in response to a signal from the sensor that the door is in the closed position and operable to actuate the valve to supply wash fluid to the spray head in response to a signal from the sensor that the door is in the open position.

18. The washing machine appliance of claim 16, further comprising a control panel positioned on the cabinet, the control panel comprising a plurality of user inputs including a water supply input, and a controller in operative communication with the water supply input and the valve, the controller operable to actuate the valve in response to a signal from the water supply input.

* * * * *